United States Patent [19]

Eke

[11] Patent Number: 4,661,670

[45] Date of Patent: Apr. 28, 1987

[54] MICROWAVE OVENS HAVING MODIFIED FINAL COOKING STAGES

[75] Inventor: Kenneth I. Eke, South Croydon, England

[73] Assignee: Microwave Ovens Limited, Surrey, England

[21] Appl. No.: 815,531

[22] Filed: Jan. 2, 1986

[30] Foreign Application Priority Data

Jan. 3, 1985 [GB] United Kingdom ..... 8500096
Feb. 1, 1985 [GB] United Kingdom ..... 8502571

[51] Int. Cl.[4] ..... H05B 6/68

[52] U.S. Cl. ..... 219/10.55 B; 219/10.55 E; 99/325; 426/243; 426/523

[58] Field of Search ..... 219/10.55 B, 10.55 R, 219/10.55 M, 10.55 E; 99/325, 451, DIG. 14; 426/243, 523

[56] References Cited

U.S. PATENT DOCUMENTS

| | | | |
|---|---|---|---|
| 4,309,584 | 1/1982 | Terakami | 219/10.55 B |
| 4,345,134 | 8/1952 | Tanaka et al. | 219/10.55 B |
| 4,463,238 | 7/1984 | Tanabe | 219/10.55 B |
| 4,508,947 | 4/1985 | Eke | 219/10.55 B |
| 4,582,971 | 4/1986 | Ueda | 219/10.55 B |

FOREIGN PATENT DOCUMENTS 122710 10/1984 United Kingdom .

*Primary Examiner*—Philip H. Leung
*Attorney, Agent, or Firm*—Penrose Lucas Albright

[57] ABSTRACT

A microwave oven has a magnetron for producing microwave power and a resistance heating element over which air is forced by a fan to produce a forced flow of hot air through the oven cavity. A thermistor in the hot air flow senses the temperature of the hot air. Microwave power and hot air are produced simultaneously until the sensed hot air temperature reaches a predetermined threshold temperature (T1). For baked food items this represents the end of the cooking process, but for meat items there is a final cooking stage during which no hot air is forced through the cavity, the level of microwave power being doubled during the final stage. The end of the final stage occurs when the sensed temperature drops to a predetermined threshold (TS). The absence of forced hot air during the final stage makes the detection of the predetermined threshold temperature (TS) easier, because the slope of the hot air temperature/time curve is steeper than would be the case if hot air were produced to the end of the cooking process.

8 Claims, 11 Drawing Figures

MICROWAVE OVENS HAVING MODIFIED FINAL COOKING STAGES

FIELD OF THE INVENTION

This invention relates to microwave ovens and to methods of cooking food.

BACKGROUND OF THE INVENTION

The applicant's European Patent Specification No. 0122710 discloses a microwave oven which delivers microwave power to the oven cavity simultaneously with thermal power provided by a circulation of hot air forced through the cavity by a fan. A temperature sensor (sensing temperature of the hot air) and a timing means monitor the temperature/time variation. If a predetermined maximum temperature (e.g. 250° C.) of the hot air is reached in a predetermined time (e.g. thirty minutes) from commencement of cooking with the oven in a cold condition, the oven automatically switches off to finish the cooking process. Most food items other than large meat or casserole dishes will be cooked within the predetermined time by this method. For larger meat and casserole dishes, where the maximum temperature is reached after the predetermined time, the delivery of microwave power is increased and the delivery of thermal power is decreased when the maximum temperature is reached in order to complete cooking of these denser food items. For such denser food items, the hot air temperature decreases with time after the predetermined time has elapsed, but the curve has a small (negative) slope which means that inaccuracies can arise if the end of cooking is determined by the temperature dropping to any set level.

The present invention relates to a modified method of cooking such denser food items which do not reach the predetermined maximum temperature within the predetermined time, the aim of the modification being to increase the slope of the temperature/time curve during the final stage of cooking to make switch-off more precise in time.

SUMMARY OF THE INVENTION

According to one aspect of the invention a microwave oven comprises a microwave generator for supplying microwave power to a cavity of the oven, thermal heating means for supplying thermal power in the form of a forced flow of hot air through the cavity, timing means for monitoring cooking time, temperature sensing means for sensing the temperature of the hot air flow, and control means which are responsive to the timing means and the temperature sensing means and which, when the sensed temperature reaches a predetermined level due to the simultaneous generation of microwave power and thermal power, are operative either to switch off the supply of power to the microwave generator and the thermal heating means and thereby finish the cooking process if the cooking time is less than a predetermined time, or if the cooking time is greater than the predetermined time to finish the cooking process by the application of microwave power without any thermal power during a final cooking stage, until the sensed temperature drops to a predetermined switch off temperature at which the supply of microwave power ceases.

According to another aspect of the invention a microwave oven comprises a microwave generator for supplying microwave power to a cavity of the oven, thermal heating means for supplying thermal power in the form of a forced flow of hot air through the cavity, selector means for selecting a first cooking program appropriate to a baked item, a second cooking program appropriate to a meat joint other than poultry, and a third cooking program appropriate to poultry, temperature sensing means for sensing the temperature of the hot air flow and control means which are responsive to the selector means and the temperature sensing means and which, when the sensed temperature reaches a predetermined level due to the simultaneous generation of microwave power and thermal power, are operative either to switch off the supply of power to the microwave generator and the thermal heating means and thereby finish the cooking process if the first program has been selected, or if the second or third program has been selected are operative to finish the cooking process by the application of microwave power without any thermal power during a final cooking stage, until the sensed temperature drops to a predetermined switch off temperature at which the supply of microwave power ceases.

When cooking poultry, the final stage preferably commences when the sensed temperature reaches the predetermined level and finishes when the sensed temperature reaches the predetermined switch off temperature. During the final stage the microwave power is preferably increased compared with the level of microwave power generated prior to the sensed temperature reaching the predetermined level. Preferably, the microwave power level is doubled when the sensed temperature reaches the predetermined level, the supply of thermal power also being discontinued at this point so that no hot air is produced during the final cooking stage.

The temperature sensing means preferably sense the temperature of the hot air flow at a position just downstream of an electric resistance heating element over which the air is recirculated by a fan.

When cooking meats other than poultry, there is preferably an intermediate stage commencing when the sensed temperature reaches the predetermined level and lasting until the sensed temperature drops to an intermediate threshold when the final stage commences. During the intermediate stage, the amount of thermal power is preferably reduced, and the amount of microwave power is preferably increased, compared with the respective power levels obtaining prior to the sensed temperature reaching the predetermined level.

When cooking poultry items the sensed temperature will take longer to reach the predetermined level than for meat items excluding poultry. This time difference can be used to advantage as the temperature/time variation detected by the oven can be used to sense whether the item being cooked is a poultry item or a meat item other than poultry. If the temperature/time variation indicates that a poultry item is being cooked, when the sensed temperature reaches the predetermined level the oven switches immediately into the final cooking stage during which no hot air is produced. Alternatively, if the temperature/time variation indicates that a meat item other than poultry is being cooked, then the oven commences the intermediate stage when the sensed temperature reaches the predetermined level, and commences the final cooking stage when the sensed temperature reaches the intermediate threshold.

Preferably the oven has the facility to prolong the cooking process for a predetermined proportion of the time occupied by the cooking process, the prolongation being at the levels of microwave power and thermal power prevailing at the switch-off time. Said predetermined proportion may be between 15% and 25%, preferably about 20%.

According to a yet further aspect of the invention there is provided a method of cooking a red meat or poultry item in a microwave oven, comprising commencing with a cavity of the oven in a cold condition, simultaneously applying microwave power and thermal power in the form of a forced flow of hot air through the oven cavity until the hot air temperature reaches a predetermined level, after which the cooking process is finished by the application of microwave power without any thermal power during a final cooking stage, until the hot air temperature drops to a predetermined switch-off temperature at which the supply of microwave power ceases.

The invention will now be further described by way of example with reference to the accompanying drawings in which:

DESCRIPTION OF THE PREFERRED EMBODIMENTS

Figure 1:
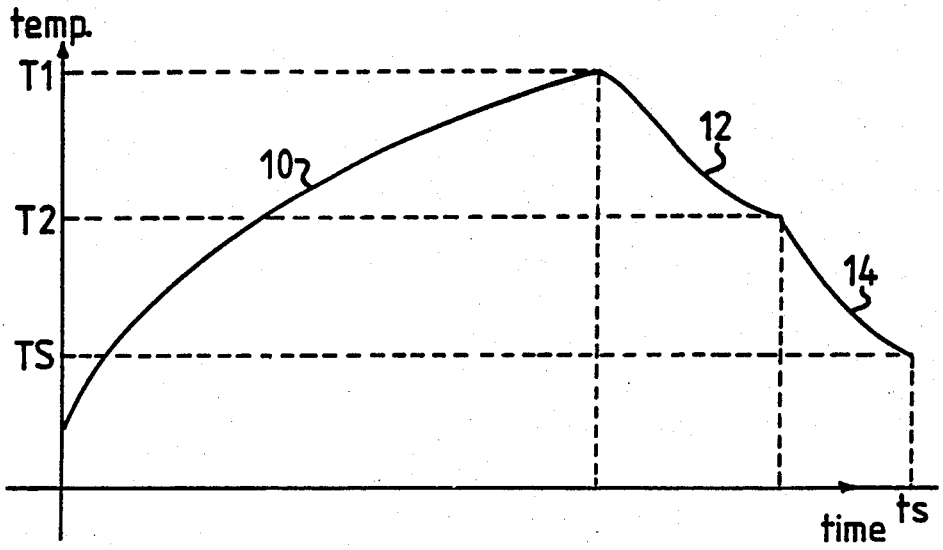
FIG. 1 is a temperature/time graph showing the variation of hot air temperature with time for a meat item other than poultry cooked in a first microwave oven capable of cooking in an automatic mode.
Figure 2:
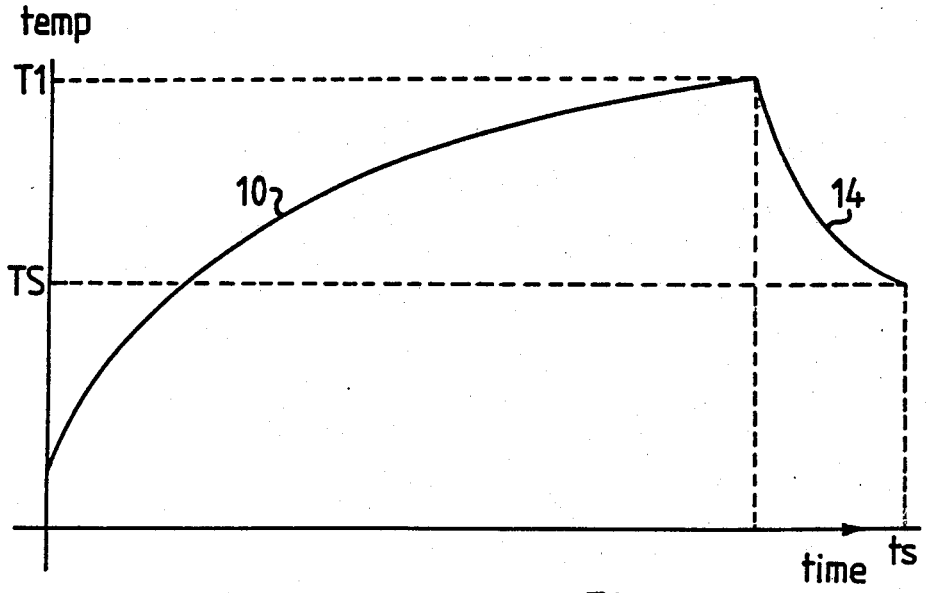
FIG. 2 is a graph corresponding to FIG. 1 but showing the temperature/time variation for a poultry item.

The first microwave oven according to the invention is similar to that described in the applicant's European patent application No. 0122710, except that the control means governing the operation of the microwave power and the thermal power are modified so that meats other than poultry are cooked according to the graph of FIG. 1 and poultry items are cooked according to the graph of FIG. 2. Food items other than meats are cooked in the manner described in the referenced European patent application.

The oven has temperature sensing means which comprises a thermistor positioned in the hot air stream just downstream of an electric resistance heating element. The electric resistance element is positioned in a compartment behind the back wall of the oven cavity, as described in the referenced European patent application.

Referring to FIG. 1, a meat item other than poultry is subjected to simultaneous microwave power and forced hot air during an initial stage 10 during which the sensed temperature rises steadily with time. When the sensed temperature reaches a predetermined level T1 the microwave power level is doubled and the thermal power level is halved for an intermediate stage 12 during which the hot air temperature declines until it reaches a predetermined intermediate threshold temperature level T2. At temperature T2, a final cooking stage 14 commences. During the final cooking stage 14 the microwave power level is maintained at its doubled value but no thermal power is produced. The temperature/time variation therefore drops more steeply during this final cooking stage 14 . When the sensed temperature reaches a predetermined switch off temperature TS, the production of microwave power ceases to mark the end of the cooking process at the time ts. The steepness of the curve in the final cooking stage 14 provides a precise cut off point at the switch off temperature TS.

During the initial stage 10, the power level may be 200 watts microwave power into the cavity and 1130 watts of hot air, and during the intermediate stage 12 the respective power levels may be 500 and 550 watts. During the final stage 14, the microwave power level remains at 500 watts but there is no hot air produced. Temperature T1 may be about 255° C. and temperature T2 about 200° C.

The temperature/time curve for a poultry item is shown in FIG. 2. During the initial stage 10, microwave power and hot air power are applied simultaneously to the oven cavity until the sensed temperature reaches the predetermined level T1. This occurs at a time longer than that required for a meat item other than poultry to reach this predetermined temperature level T1. When temperature T1 is reached, the microwave oven switches into its final cooking stage 14 during which the microwave power level is doubled but no hot air is produced. The temperature/time curve during the final stage 14 therefore drops fairly steeply to provide a precise cut off at the predetermined switch off temperature TS when cooking ceases at time ts. The power levels during stages 10 and 14 in FIG. 2 correspond to the power levels in the stages 10 and 14 in FIG. 1.

It will be appreciated that for poultry items and for meat items other than poultry the operation after the sensed temperature has reached the predetermined level T1 is governed by the falling off of the sensed temperature and not by time. As a result of producing no hot air during the final cooking stage 14, the temperature/time curve drops sharply to produce a precise cut off point at the predetermined switch off temperature TS.

The first embodiment of microwave oven is capable of cooking in automatic mode, in that the user does not need to pre-select any particular cooking program. The cooking program actually followed in any particular case will be dependent on the temperature/time curve, and in particular the time when the threshold temperature T1 is reached, as described in the aforementioned European patent application.

Some users prefer to have more control over the cooking process, and the second microwave oven has been developed to meet this need. The second microwave oven is semiautomatic in operation, in that the user pre-selects a program appropriate to the type of food item being cooked, but the manner in which the selected program proceeds is dependent on the temperature/time variation.

Figure 3:
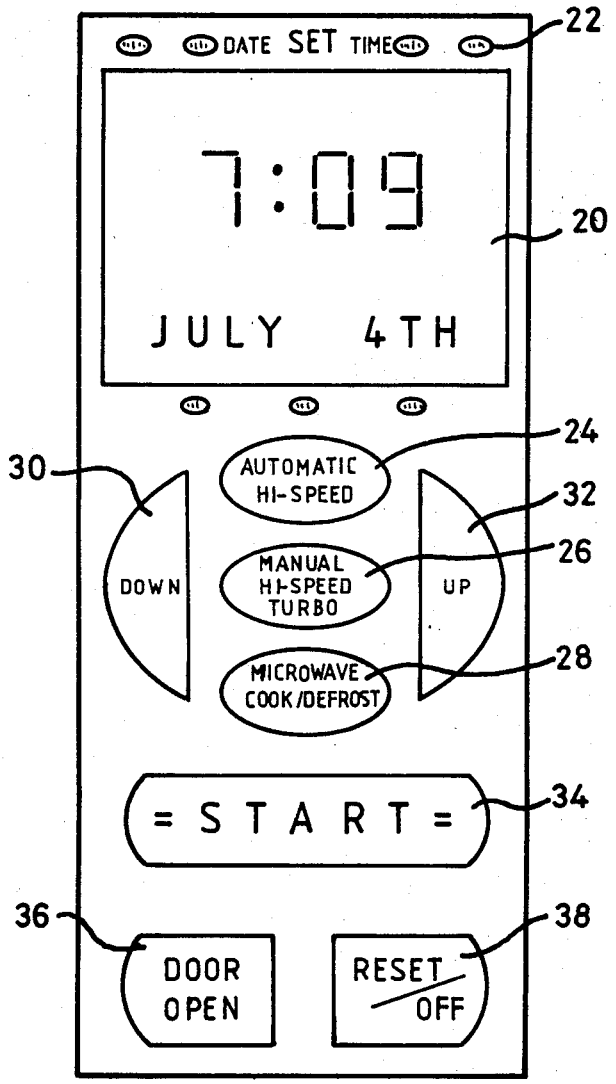
FIG. 3 shows the control panel of the second microwave oven capable of cooking in a semi-automatic mode.

FIG. 3 shows the control panel of the second oven. The panel has a display 20 depicting time and date, together with pads 22 for setting the time and date. Under the display 20 are a pad 24 depicted "Automatic Hi-Speed", a pad 26 depicted "Manual Hi-Speed Turbo" and a pad 28 depicted "Microwave Cook/Defrost". On respective sides are pads 30, 32 marked "Down" and "Up". A large touch pad 34 marked "Start" is provided, and pads 36, 38 marked "Door Open" and "Reset/Off" complete the display panel.

The second oven is again similar in circuit components to that disclosed in the applicant's European patent application published under No. 0122710 in that the microwave power is delivered to the oven cavity simultaneously with thermal power provided by a circulation of hot air forced through the cavity by a fan. A temperature sensor in the hot air flow and timing means monitor the temperature/time variation. A microprocessor controls the magnitude and duration of the application of the microwave power, and the magnitude and duration of the thermal power, in dependence upon temperature/time variation.

However, the oven is capable of following a selected one of six cooking programs appropriate to the foodstuff being cooked. For example, if the user wishes to cook a baked foodstuff, e.g. a pastry item, the pad 24 is touched and this causes the microprocessor to control the microwave power and the thermal power so that a cooking procedure appropriate to baked items is followed. The pad 24 is touched a second time if a frozen item is to be defrosted and cooked. The pad 24 is touched a third time if a red meat item is to be cooked, and the pad 24 is touched a fourth time if a poultry item is to be cooked. The pad 24 is touched a fifth time if a complete individual meal is to be cooked, and the pad 24 is touched a sixth time if a pre-cooked food item is to be heated.

Once the pad 24 is touched the number of times appropriate to the foodstuff being cooked, the oven performs the appropriate cooking procedure and terminates the cooking procedure at a switch-off time which will be dependent on the temperature/time variation. If, at switch-off time, the food item is considered not to be cooked the user can again press the "Start" pad 34 which then serves as an 'extra-time' pad and automatically prolongs the cooking procedure for a further 20% of the cooking time from commencement of cooking to switch-off time.

Pad 38 is a reset/cancel pad which is operative to cancel any previously selected cooking procedure entered in by pad 24. Pads 30 and 32 (marked "Down" and "Up") enable less or more well cooked results to be achieved, respectively. For example, if the pad 24 is touched three times to select the red meat cooking program and the pad 30 is touched, the meat item cooked will be rarer than if pad 30 had not been touched. Similarly, if pad 32 is touched instead of pad 30 the meat item will be well done.

Figure 4:
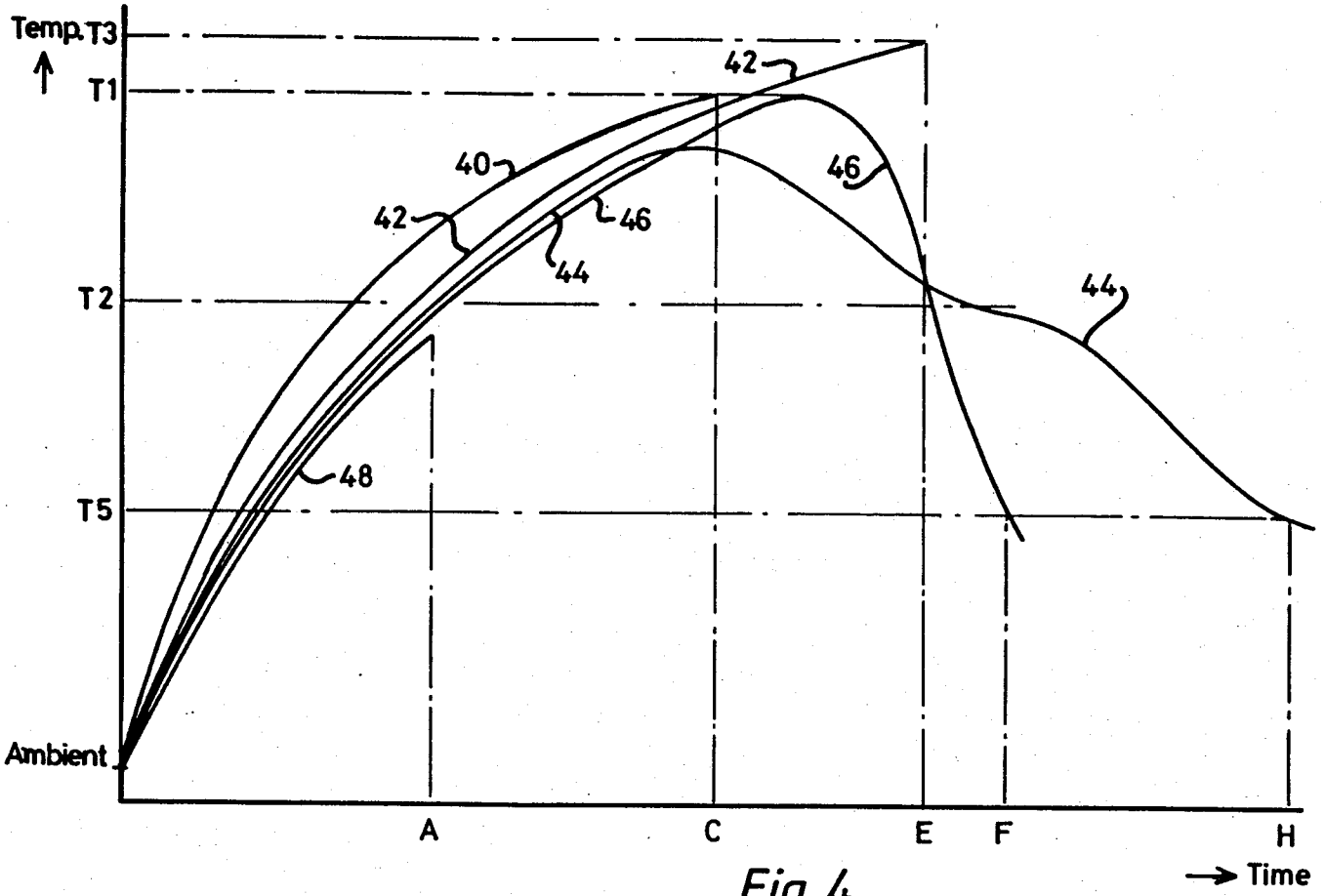
FIG. 4 is a graph showing the temperature/time variations for differing foods cooked in the second microwave oven.

FIG. 4 shows the temperature/time variations followed for typical cooking procedures in the second oven. Curve 40 is the temperature/time variation for a typical baked item consequent upon touching of the pad 24 once. The oven automatically switches off when a threshold temperature T1 is reached, which occurs at time C. Curve 42 shows the temperature/time variation for a frozen item which is first defrosted and then cooked, cooking finishing when a predetermined temperature T3 is reached, which occurs at switch off time E. Curve 44 is the temperature/time variation for red meats, cooking finishing at time H. Curve 46 is the temperature/time variation for poultry, for which cooking finishes at time F. Curve 48 is for items which are being re-heated, which lasts until time A. Curve 46 results from there being a final cooking stage like stage 14 of FIG. 2, and curve 44 results from there being an intermediate cooking stage and a final stage, corresponding to stages 12 and 14 of FIG. 1. It will be noted that curve 44 commences its intermediate stage at a lower temperature than does the curve 46 commence its final stage, this being the only significant difference as between the automatic oven (FIGS. 1 and 2) and the semiautomatic oven (FIG. 4).

In each case, if extra time is selected after the selected cooking procedure has been completed, the microprocessor remembers the last mode it was operating in and the overall time taken and automatically programs the oven to cook for a further 20% of that time. Hence, if a baked item is cooked and the oven switches off at time C of 20 minutes, subsequent selection of extra time will cause the oven to continue the cooking procedure for a further 4 minutes.

Figure 5A:
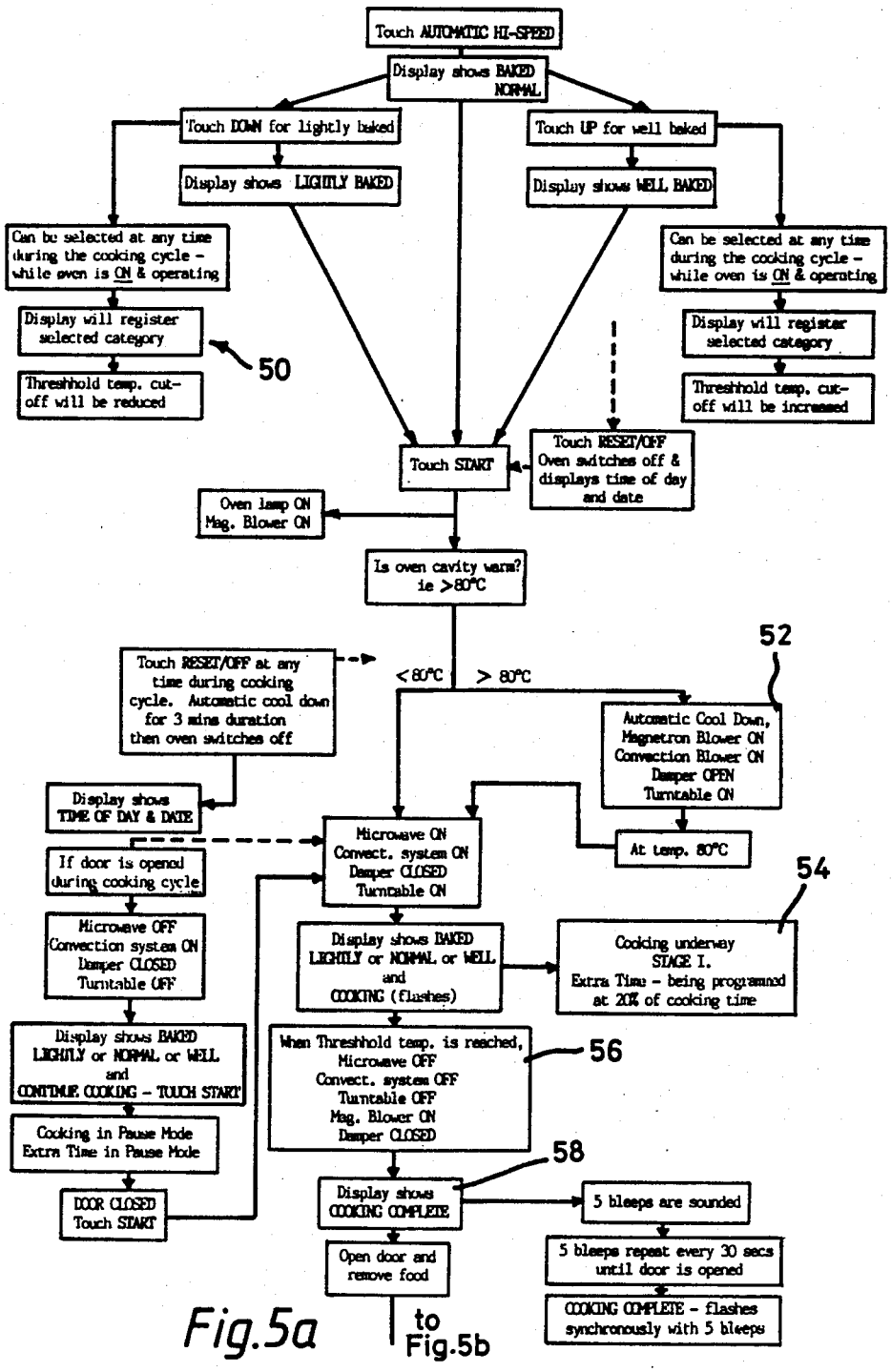
FIGS. 5*a* and 5*b* are together a flow chart depicting the cooking process for a baked item of food cooked in the second microwave oven.
Figure 5B:
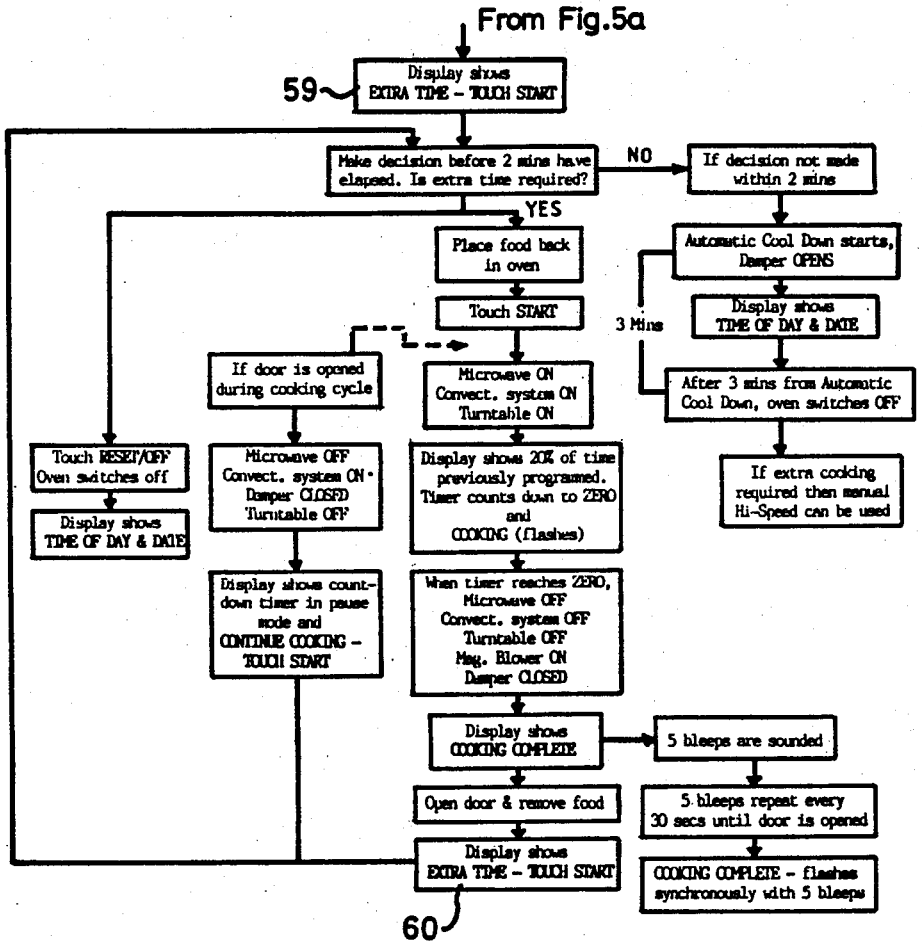

When the pad 24 is touched once, to select a program appropriate to a baked item, the second microwave oven follows a cooking procedure shown in the flow chart of FIGS. 5*a* and 5*b*. The part of the procedure shown at 50 is the selection of the 'baked' program, with the option for lightly baked or well baked, and the starting of cooking by touching the pad 34. If the temperature (as detected by the thermistor in the rear compartment) is above 80° C., automatic cool down of the oven cavity is achieved by directing cooling air through the oven cavity from the magnetron blower and the convection blower, as indicated at 52.

As cooking proceeds, the total cooking time is monitored (at 54) and the display 20 shows the program selected and whether the Down or Up pad was touched. When the threshold temperature T1 is reached, the production of microwave power and convection power ceases (at 56), and the display 20 then shows "Cooking Complete" (at 58).

After the oven door has been opened, the display 20 invites the user to select the option of extra time. If this is required, the user again presses the start pad 34 (as indicated at 59), and the oven automatically continues both microwave power and thermal power, at the levels prevailing immediately before switch off, for a further time equal to 20% of the time from commencement of cooking to switch off.

Yet further extra time may be selected (69) if the user wishes.

During any extra time cooking, the display 20 shows 20% of the cooking time as monitored at 54, and the timer counts down to zero.

Figure 6:
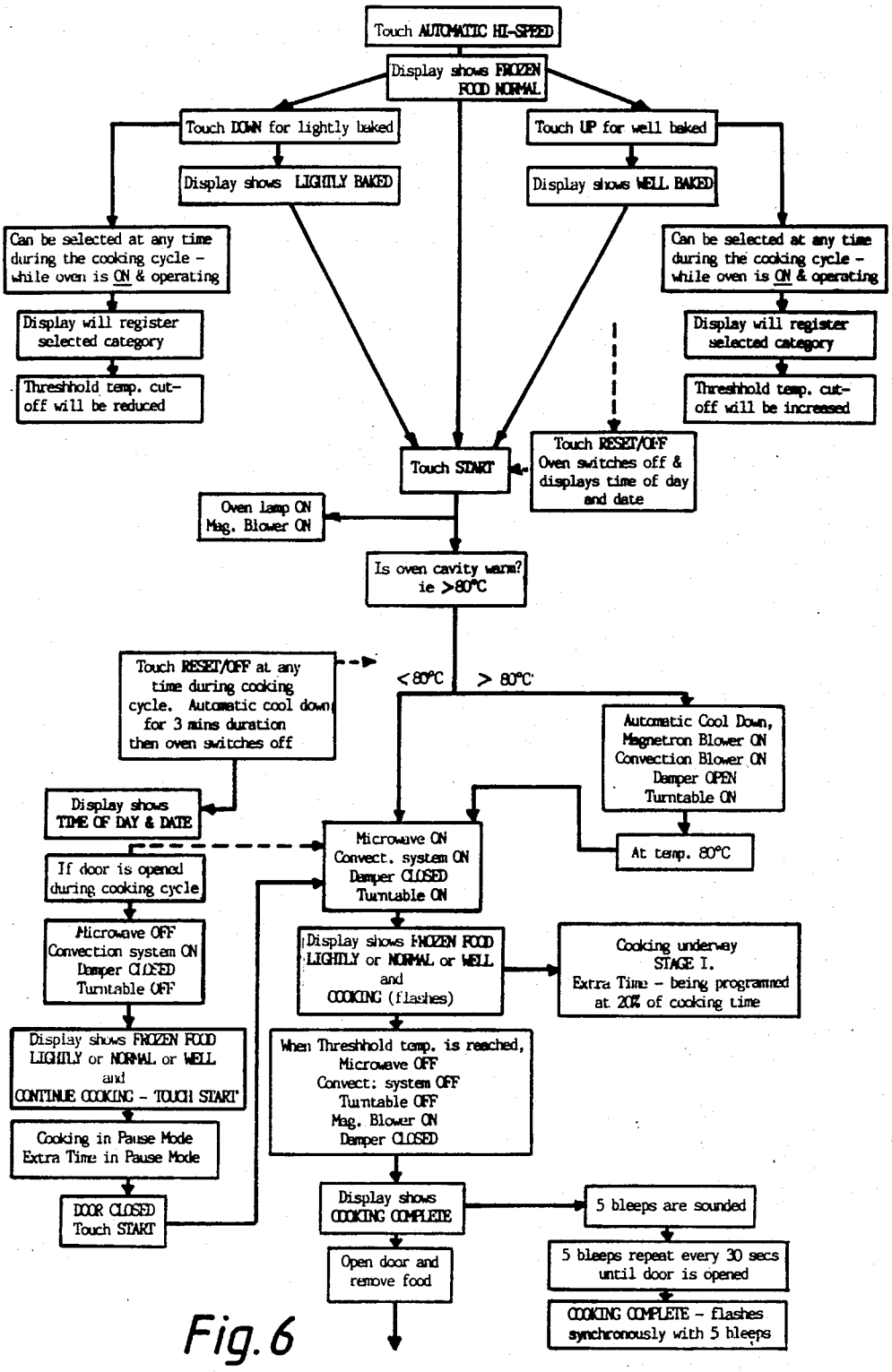
FIGS. 6 to 10 are flow charts depicting the first parts of cooking processes of five differing foodstuffs cooked in the second microwave oven.

FIG. 6 corresponds to FIG. 5*a*, but shows the flow chart appropriate to the program for frozen foods. The remainder of the program for frozen foods is identical to that for baked items, so FIG. 6 should be combined with FIG. 5*b* for the complete flow chart for frozen food items.

Figure 7:
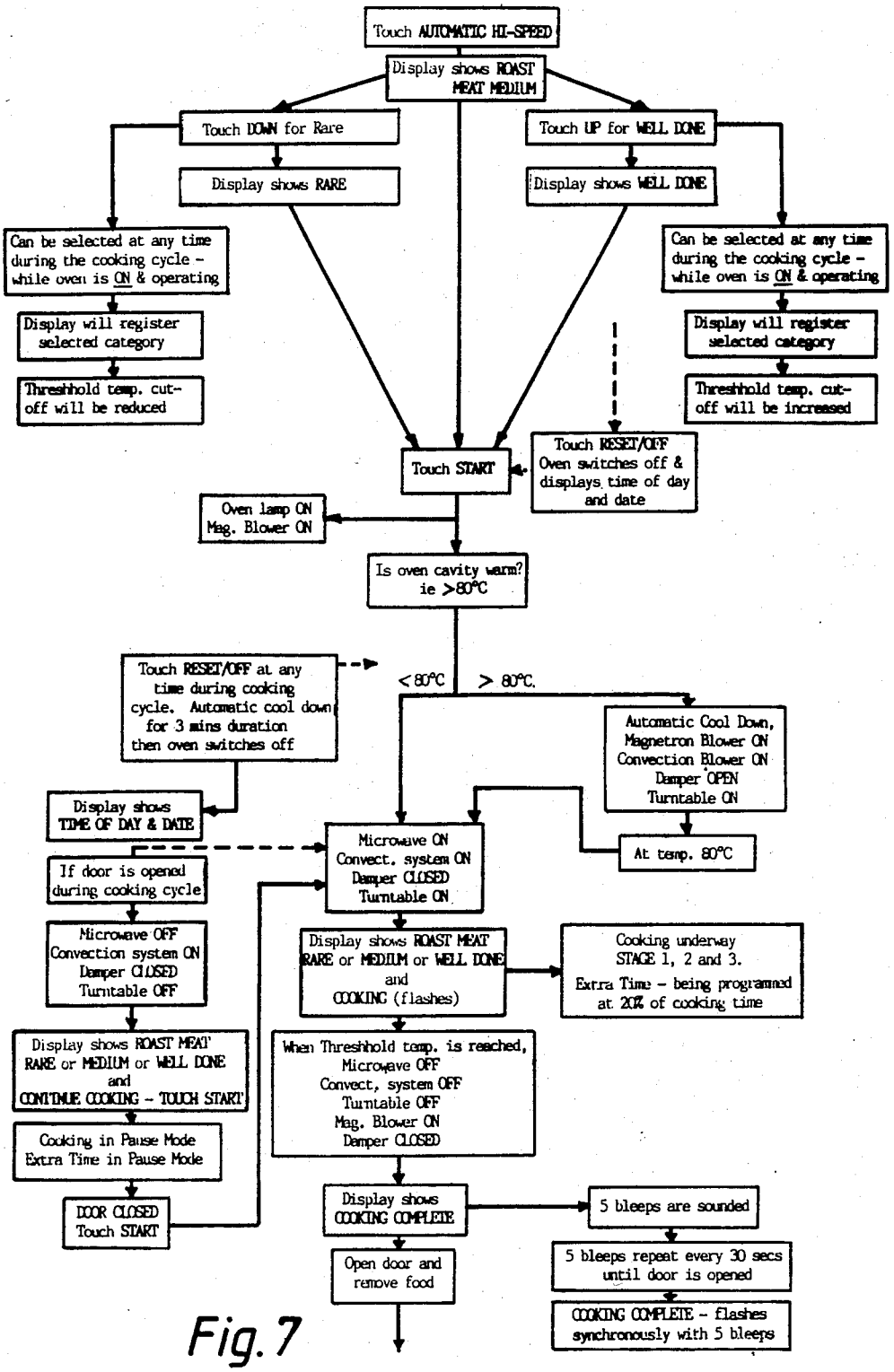

Similarly, FIG. 7 corresponds to FIG. 5*a*, but shows the flow chart appropriate to roast meats. It will be seen that the program has stages 1, 2 and 3 corresponding to the curve 44 of FIG. 4. The remainder of the program for roast meats is identical to that for baked items, so FIG. 7 should be combined with FIG. 5*b* for the complete flow chart for roast meat items.

Figure 8:
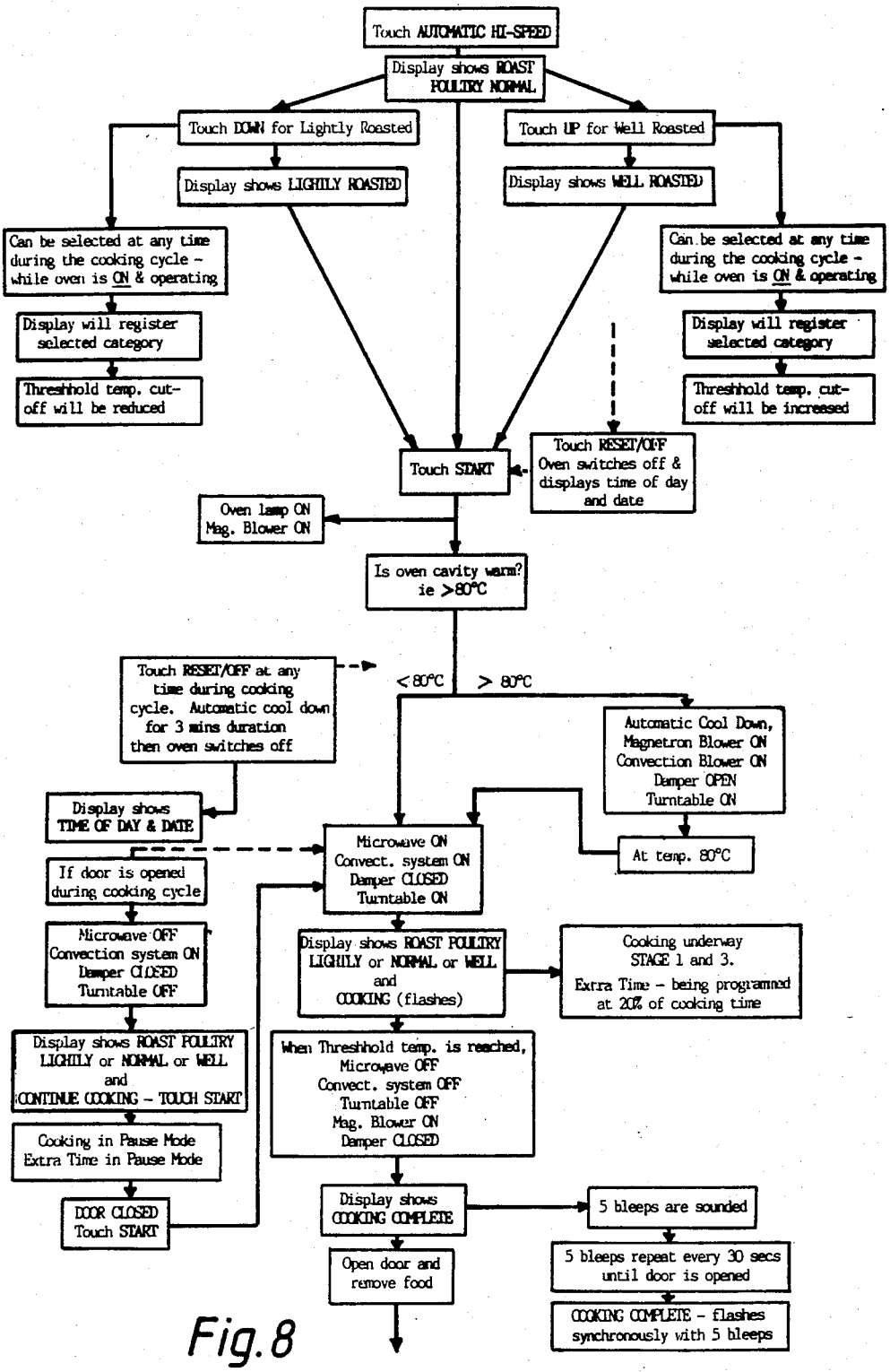

FIG. 8 corresponds to FIG. 5*a*, but shows the flow chart appropriate to poultry. It will be seen that the program has stages 1 and 3, corresponding to the curve 46 of FIG. 4. The remainder of the program for poultry is identical to that for baked items. So FIG. 8 should be combined with FIG. 5*b* for the complete flow chart for poultry items.

Figure 9:
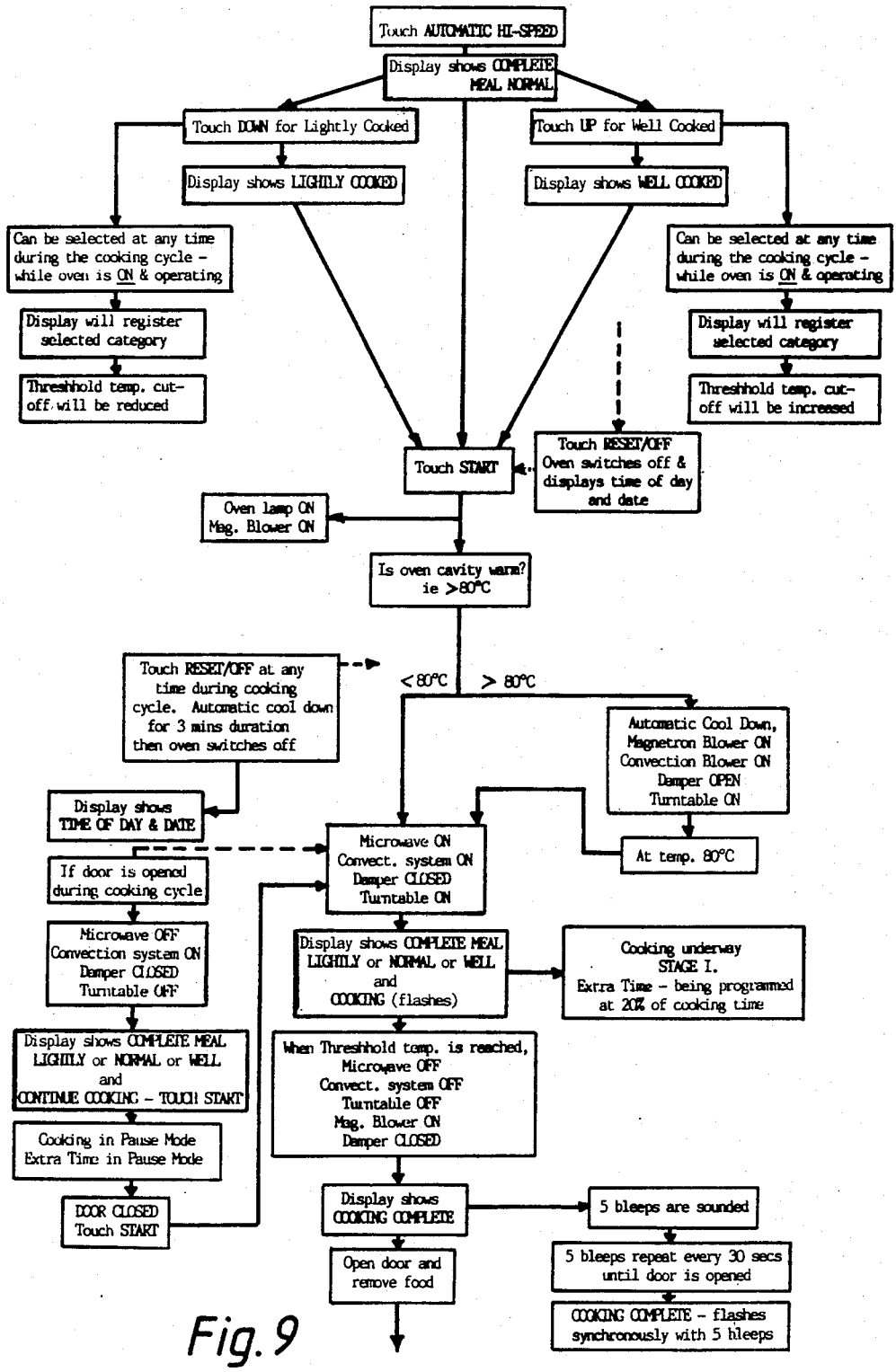
Figure 10:
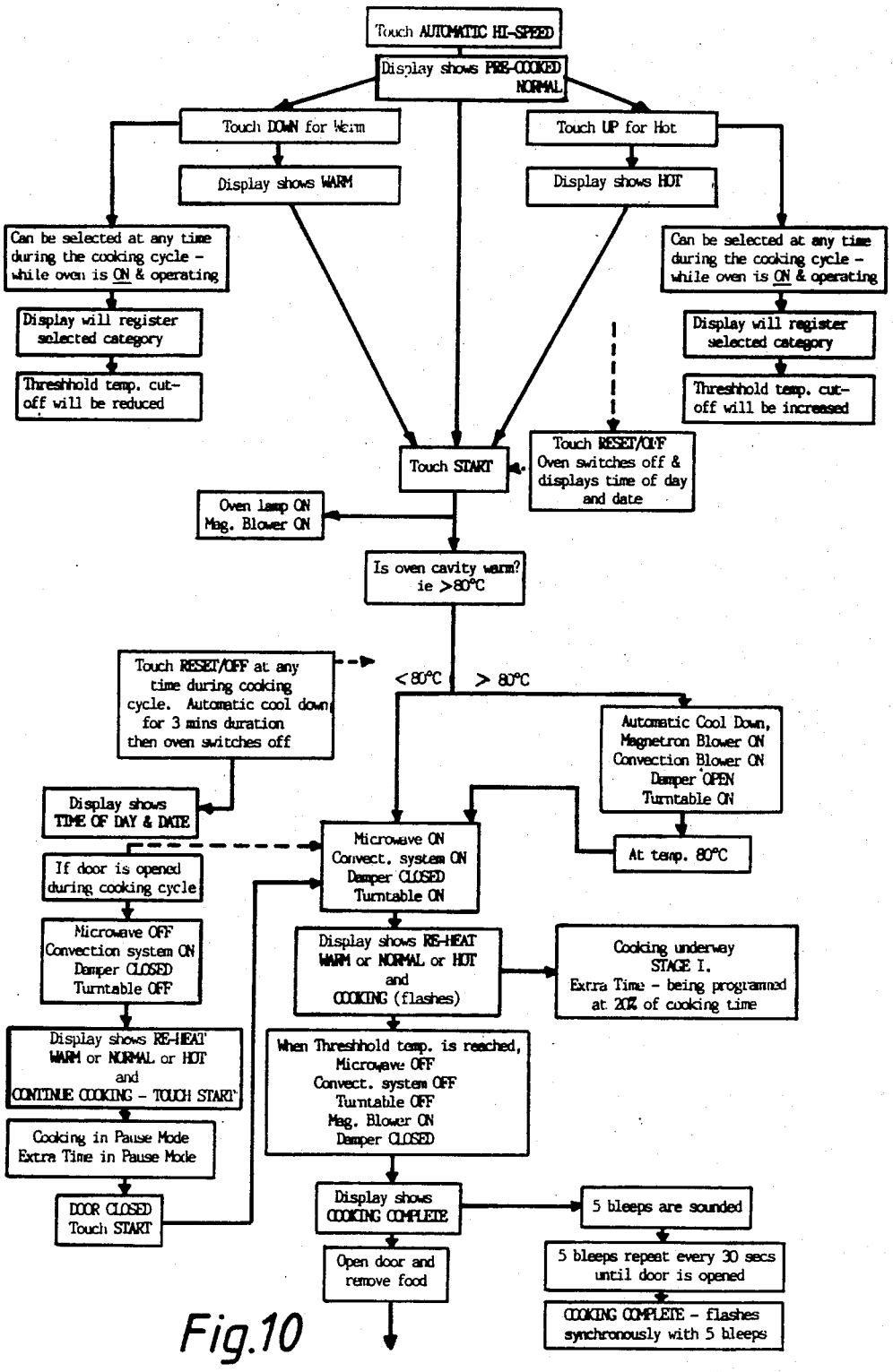

FIGS. 9 and 10 correspond to FIG. 5*a*, but show the flow charts appropriate to cooking complete individual meals and heating pre-cooked foods, respectively.

Having disclosed my invention what I claim as new and to be secured by Letters Patent of the United States is:

1. A microwave oven comprising a microwave generator for supplying microwave power to a cavity of the oven, thermal heating means for supplying thermal power in the form of a forced flow of hot air through the cavity, memory means storing a first cooking program appropriate to a baked item, a second cooking program appropriate to a meat joint other than poultry, and a third cooking program appropriate to poultry, selector means for selecting one of said first, second and third cooking programs, temperature sensing means for sensing the temperature of the hot air flow, and control means which are responsive to the selector means and the temperature sensing means and which, when the sensed temperature reaches a predetermined level due to the simultaneous generation of microwave power and thermal power, are operative either to switch off the supply of power to the microwave generator and the thermal heating means and thereby finish the cooking process if the first program has been selected, or if the second or third program has been selected, are operative to finish the cooking process by the application of microwave power without any application of thermal power during a final cooking stage, until the sensed temperature drops to a predetermined switch off temperature which is lower than the predetermined temperature level and at which the supply of microwave power ceases.

2. A microwave oven according to claim 1, wherein the final stage commences when the sensed temperature reaches the predetermined level and finishes when the sensed temperature reaches the predetermined switch off temperature.

3. A microwave oven according to claim 1, wherein during the final stage the microwave power is increased compared with the level of microwave power generated prior to the sensed temperature reaching the predetermined level.

4. A microwave oven according to claim 3, wherein the microwave power level is doubled when the sensed temperature reaches the predetermined level, the supply of thermal power then being discontinued so that no thermal power is produced during the final cooking stage.

5. A microwave oven according to claim 1, wherein there is an intermediate stage commencing when the sensed temperature reaches the predetermined level and lasting until the sensed temperature drops to an intermediate threshold when the final stage commences.

6. A microwave oven according to claim 5, wherein during the intermediate stage, the amount of thermal power is reduced, and the amount of microwave power is increased, compared with the respective power levels obtaining prior to the sensed temperature reaching the predetermined level.

7. A microwave oven according to claim 1, wherein the oven comprises means for prolonging the cooking for a predetermined proportion of the time occupied by the cooking process to switch-off time, to provide a prolongation of the cooking time beyond the switch-off time, the prolongation being at the levels of microwave power and thermal power prevailing at the switch-off time.

8. A microwave oven according to claim 7, wherein the predetermined prolongation proportion is substantially between 15% and 25% of the time occupied by the cooking process to switch-off time.

* * * * *